US005135384A

United States Patent [19]

Redwine

[11] Patent Number: 5,135,384

[45] Date of Patent: Aug. 4, 1992

[54] MOLDING MACHINE

[75] Inventor: Tom W. Redwine, St. Louis, Mo.

[73] Assignee: Seagren Industries, Inc., St. Louis, Mo.

[21] Appl. No.: 549,282

[22] Filed: Jul. 6, 1990

[51] Int. Cl.[5] ..... B28B 13/04

[52] U.S. Cl. ..... 425/424; 249/137; 425/253; 425/260; 425/413; 425/439

[58] Field of Search ..... 425/253, 260, 413, 424, 425/432, 439, 448, 452; 249/137

[56] References Cited

U.S. PATENT DOCUMENTS

| | | | |
|---|---|---|---|
| 1,524,877 | 2/1925 | Norton | 425/439 |
| 1,707,994 | 4/1929 | Romie | 425/439 |
| 1,829,795 | 11/1931 | Garvin | 425/439 |
| 2,235,440 | 3/1941 | Mackert | 425/439 |
| 2,298,446 | 10/1942 | White | 425/439 |
| 2,526,198 | 10/1950 | Clanton | 425/439 |
| 3,149,392 | 9/1964 | Ripley | 425/439 |
| 4,004,869 | 1/1977 | Balhorn | 425/448 |
| 4,379,659 | 4/1983 | Steiner | 405/284 |
| 4,521,138 | 6/1985 | Steiner | 405/284 |
| 4,527,940 | 7/1985 | Biery | 425/439 |

*Primary Examiner*—Tim Heitbrink
*Attorney, Agent, or Firm*—Heller & Kepler

[57] ABSTRACT

A molding machine preferably for molding blocks from a premixed concrete, has a rotating mold table and a receiving conveyor that raises and lowers for ultimate transfer of the molded block to a conveyor and finally to a curing area.

20 Claims, 2 Drawing Sheets

MOLDING MACHINE

BACKGROUND OF THE INVENTION

The present invention relates in general to manufacturing building blocks and pertains, more particularly, to a molding machine for manufacturing building blocks for use in a retaining wall system. The molding machine of this invention is an improvement over the conventional molding machines now in use to manufacture the proprietary building block.

With the conventional molding machines it is generally necessary to provide a complex, relatively slow combined translation and rotation of a mold for a building block as set forth in U.S. Pat. Nos. 4,379,659 and 4,521,138, both for building blocks. A machine for molding these building blocks is known and its design and operation, along with the building blocks and their uses, as disclosed in the identified U.S. Pat. is presumed known and incorporated herein by reference.

Their may be one or more U.S. Pat. or foreign patents issued that disclose the conventional molding machine. Their identity has not been determined as of the filing of the present application. Those familiar with the building blocks are well aware that turning a mold over and removing the molded building blocks from their mold requires a combined rotation and translation movement. This complex articulation of the mold is required in part due to the fragility of the molded building block after it is released from the mold and before it is cured.

In spite of almost a decade in which to improve the conventional molding machine, the mold is still moved through the complex motion. Another drawback associated with the conventional molding machine is its relative slowness due at least in part to the following factors. One factor is the weight of the mold and its inherent inertia that precludes rapid movement.

Another factor is the fragility of the molded building block before curing. A quick movement of the mold back, up, forward, and down, would likely, it is feared, ruin the uncured building block, possibly by distorting it in the mold.

It will be understood that the building blocks manufactured by the molding machine of the present invention include those identified in the referenced United States patents and other known blocks and those blocks that may be later developed for use in association with the LOEFFELSTEIN brand retaining wall system. It will be further understood that the molding machine of this invention is suitable for use in the molding of any block that cannot be stripped through a conventional block form.

Existing concrete block forms also have a drawback related to the manufacture of any block that has a base or must be molded upside down. As an example, conventional splash blocks are made by hand to this day because of a lack of a molding machine that allows a mold to be turned over in order to strip the mold.

Accordingly, it is an object of the present invention to provide an improved molding machine that is adapted to increase the number of building blocks molded in a given period of time. The rotational motion of a mold provided for in the present invention is intended to save both time and the expense of improperly molded building blocks.

Another object of the present invention is to provide an improved molding machine for the LOEFFELSTEIN brand WATERLOFFEL brand pre-cast concrete module. It will be recognized that the molding machine of the present invention may be adapted to provide a pre-cast concrete block or module configuration to any number of shapes, dimension tolerances, unit density or weight, and concrete strengths in which utilization of the rotating mold and translating receiving assembly results in an improved molding process.

A further object of the present invention is to provide an improved molding machine that is adapted for incorporation into an otherwise conventional molding machine with its collecting hopper and feed box combination, pallet receiver, release conveyor, and appropriate mold.

Still another object of the present invention is to provide an improved molding machine that may be readily operated by a small, appropriately trained crew to further increase the molding machine output and reduce the cost of the building blocks.

Still a further object of the present invention is to provide an improved molding machine that is adapted for integration with the conventional items required for the operation of the conventional molding machine and not illustrated in the drawings, including the following; a cement storage system; sand and aggregate bins; concrete mixer; conveyors for cement, sand, aggregate and mixed concrete, including conveyor to a feed box; air compressor system; electrical service; mold release agent and associated spray unit; curing room conveyors; overhead crane, if required; drying lids, plywood for clamping mold, pallets and necessary pallet handling equipment.

Another object of the present invention is to provide an improved molding machine that incorporates the desired molding block handling features of the present invention while allowing the mold to receive the proper degree of conventional pneumatic compaction pressure and vibration.

A further object of the present invention is to provide an improved molding machine that is adapted to accommodate a mold that must be turned over in order to strip the molded block from the mold. A block that has a base or solid portion, e.g., splash block, is molded upside down, thereby requiring the mold to be turned over to strip the block from the mold.

The present invention provides a replacement for the conventional hand molding process still being practiced to manufacture pre-cast concrete blocks that cannot be stripped through a conventional mold.

Still another object of the present invention is to provide an improved molding machine that reduces the molding cycle time over conventional molding machines. The molding machine of this invention has displayed the ability to reduce the molding cycle by possibly as much as one third over the molding cycle of the conventional machine. It is believed that the present invention may reduce the molding cycle from 90 to 60 seconds, depending upon the skill of an operator.

SUMMARY OF THE INVENTION

To accomplish the foregoing and other objects of this invention there is provided a molding machine for molding precast cast concrete blocks or building blocks. The molding machine comprises a means for molding the building block and a supporting means for the molding means. The supporting means provides for rotational movement of the building block molding means.

A means for receiving a molded building block is located to receive the molded building block released from the mold. Gravity transfers the molded building block to the receiving means that has been moved into a receiving position proximate the molding means. Finally, the molded building block is conveyed into a conveying position for transfer to a curing area or room.

The supporting means may provide for rotational movement of the molding means through use of a plurality of opposing shafts mounted in suitable bearing means. The bearing mounting allows for the desired rotational support of the opposing shafts. Rotational movement is provided by a driven shaft operatively connected to the molding means supporting means.

Alternatively, rotational movement may be provided by equivalent rotational actuators, for example, a pneumatic rotational actuator. In the disclosed embodiment the means for moving the molded building block receiving means includes means for providing generally vertical movement of the building block receiving means from a molded building block receiving position to a molded building block conveying position. The vertical movement is accomplished by a pneumatic cylinder with a driven and reciprocating shaft arrangement.

While the disclosed embodiment illustrates the use of an electric motor, chain drive and clutch assembly, it will be recognized that alternative assemblies such as a pneumatic rotary actuator are equivalent.

These and other objects of the present invention will be better understood and appreciated from the following detailed description of one embodiment thereof, selected for purposes of illustration and shown in the accompanying drawings.

DETAILED DESCRIPTION

Figure 1:
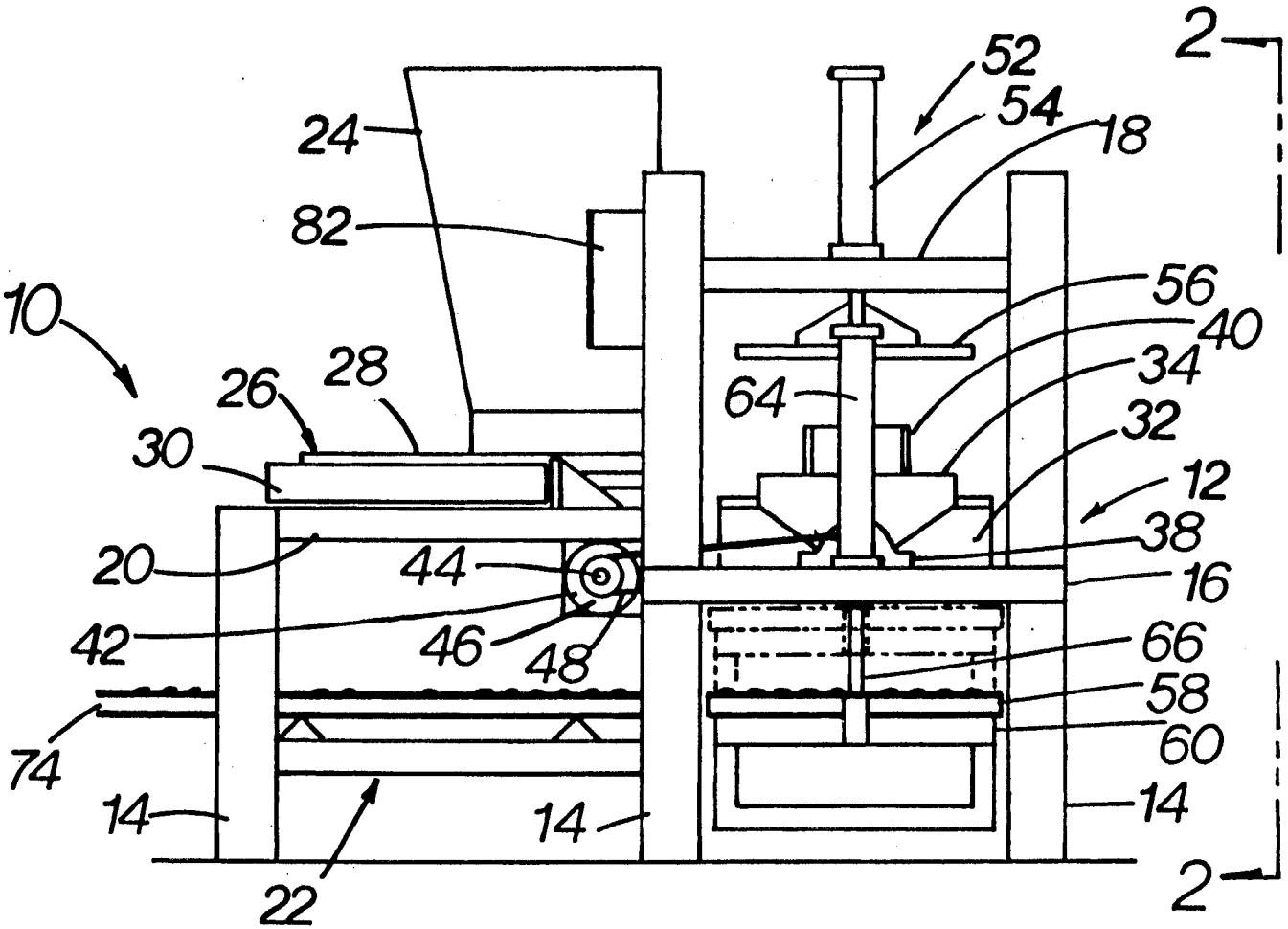
FIG. 1 is an elevation view of a molding machine constructed in accordance with the present invention.
Figure 3:
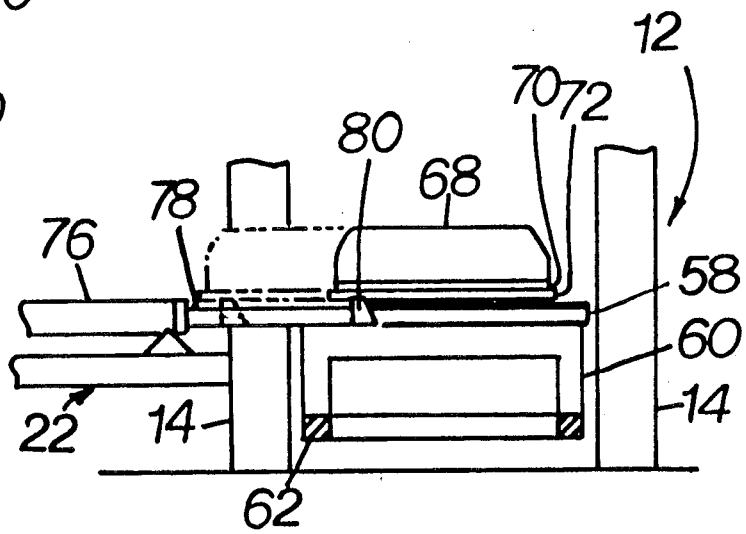
FIG. 3 is a cross-sectional view taken along line 3—3 in FIG. 2.
Figure 2:
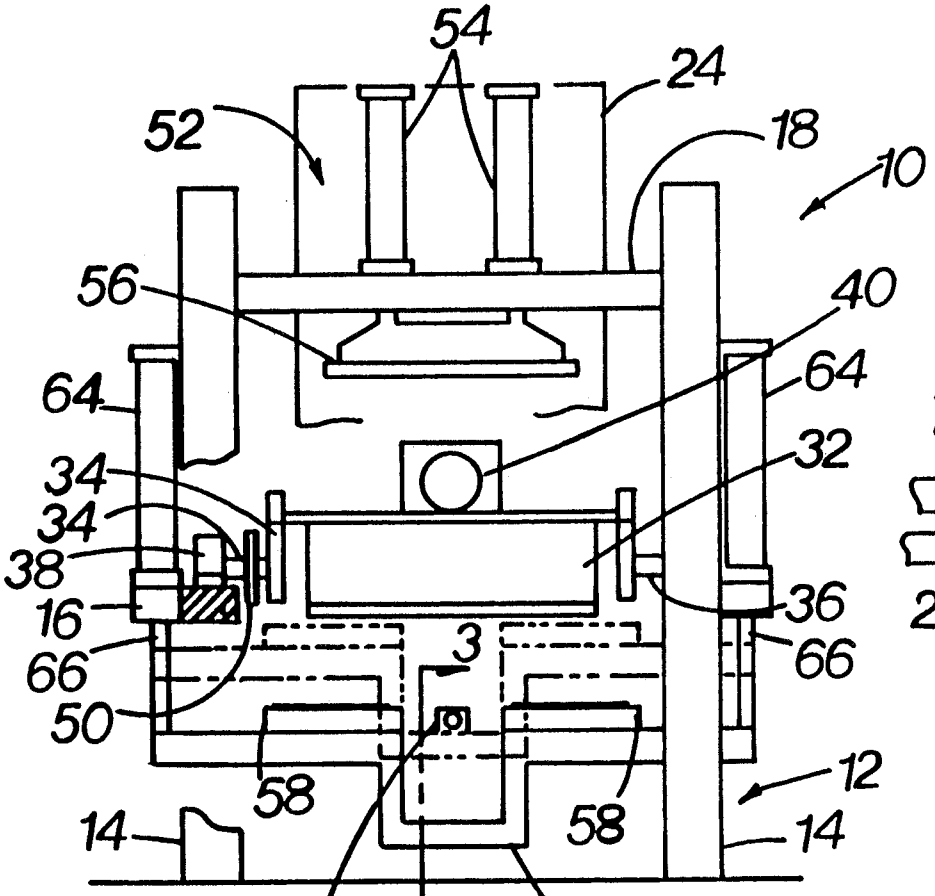
FIG. 2 is an elevation view of the molding machine taken along line 2—2 in FIG. 1.

Referring now to the drawings there is shown a preferred embodiment for a molding machine of this invention. The molding machine is described in connection with molding building blocks for the blocks and system disclosed in U.S. Pat. Nos. 4,379,659 and 4,521,138 and equivalent building blocks. It will be further understood that the molding machine of the present invention may be used for molding and manufacturing other pre-cast cement blocks.

The drawings show the molding machine 10 that comprises a supporting framework 12 with associated vertical legs 14, horizontal mold supports 16, horizontal compactor ram supports 18, horizontal feed box supports 20, and horizontal conveyor supports 22.

A feed box 24 is mounted on the framework 14 and 20 and is supplied with the necessary conventional cement mix from associated conveyors (not shown) as is already done for the conventional molding machine. The feed box 24 moves on a conventional trolley arrangement 26 in order to move the feed box to the appropriate position so that opening a feed box gate 28 allows for the gravity feed of the pre-mixed concrete.

The disclosed embodiment operates on a conventional compressed air system and provides, therefore, for operation of a number of compressed air cylinders. A feed box pneumatic cylinder 30 is illustrated for moving the feed box and performing any other of the conventional operations prior to molding a building block.

A mold 32 is supported by a mold support frame 34. In a preferred embodiment the mold 32 is bolted to the mold support frame 34. This allows the mold to be changed when it is desired to mold a different style block. The mold is unbolted, removed, and replaced with a different mold. The molds used may be one, two, three or more cavity molds.

Currently, the molds that could be provided with the molding machine of the present invention would mold a block or blocks weighing up to two hundred fifty pounds. It will be recognized that molding a heavier block will simply require a stronger support structure and means for rotating the mold 32.

Mold support shafts 36 extend out from the mold support frame 34 and are supported in conventional mold support shaft bearing blocks 38. A vibrator motor is attached to the mold support frame 34 and preferably on a plate to which the mold 32 is bolted. A mold support frame motor and associated support structure 42 is mounted on the framework 12.

The motor arrangement includes a drive shaft 44 and associated conventional clutch arrangement associated with a drive sprocket 46. A chain 48 extends between the drive sprocket and a driven sprocket 50 attached to the mold support shaft and rotates the mold 32 and mold support frame 34 to allow the molded block to be stripped from the mold.

A compactor ram assembly 52 is supported underneath a pair of compactor pneumatic cylinders 54. A ram plate 56 is attached to the cylinder arrangement and can be removed to allow fitting of a plate that fits the mold being used. The ram plate and pneumatic cylinder arrangement provides the necessary compaction of the concrete mix in the mold. This arrangement or an equivalent is utilized by the conventional molding machine.

Underneath the mold 32 and rotating mold support frame 34 a mold receiving conveyor 58 is supported on a receiving conveyor support frame 60 having a generally U-shaped or clearance member 62. Mold receiving conveyor lift cylinders 64 have reciprocating lift cylinder rods 66 attached to the support frame 60 for raising and lowering the frame.

In operation, in connection with the molding of molded building block 68, such as used in a LOEFFELSTEIN brand retaining wall system (a specification for the retaining wall system is attached as appendix I), a mold 32 (or molds) are selected and attached to the mold support frame 34. A mold release agent is sprayed into the mold 32 and the vibrator motor 40 is turned on.

It will be recognized that the air, electric service and controls are all conventional and need no further description to one skilled in the art. For purposes of illustration reference character 82 identifies a location for conventional compressed air piping and valve train and control valves.

Similar components will be found on the conventional molding machine and will be within the understanding of those skilled in the control art. It will be readily apparent that another control system may be substituted for the one disclosed herein without departing from the scope of the present invention.

The feed box 24 moves over the mold 32 and the desired amount of concrete drops into the mold and the feed box returns to its initial position. The ram plate 56 is driven down into the mold 32 to compact the concrete. The depth of compaction will vary with the building block or other concrete member being molded. Manufacturers' specifications may be consulted for suggested compaction. The compactor cylinders 54 are again activated to raise the ram plate 56.

A plywood panel 70 or other suitable board to support the compacted and vibrated molded building block 68 is placed over the top of the mold and clamped to the mold (not shown). The mold, which has been latched in place, is released and rotated to the upside down position depicted in the drawing figures.

The mold receiving conveyor 58 is raised with the lift cylinders 64 to a position beneath the now upside down mold 32. A pallet 72 for receiving the molded block 68 is in place on the receiving conveyor. The clamps are released and the block 68 stripped from the mold 32. The vibrator motor 40 may be used to assist in gravity stripping the mold if the release agent has not proven completely effective. In a preferred embodiment this arrangement of the invention requires that the block 68 need drop only approximately three eighths of an inch onto the pallet 72.

The mold receiving conveyor 58 is lowered into position for transferring the pallet onto an adjacent conveyor 74 (e.g., a conventional roller conveyor) for further transfer to a curing area or room. A mold puller pneumatic cylinder 76 is activated to retract a shaft 78 in order that a finger member 80 engages the pallet 72 and transfers the pallet onto the conveyor 74. It will now be apparent that the U-shaped member 62 of the receiving conveyor support frame 60 provides the necessary clearance for movement of the shaft and finger arrangement.

The cycle is completed with the mold 32 rotating back to its concrete mix receiving position and the shaft 78 extending and ready to pull the next pallet and mold.

In a preferred embodiment the operations of the machine are controlled by an operator through the electrically operated valves and compressed air system. The speed of molding machine operation will depend on the proficiency of the operator. Air pressure gauges and bearing and motor lubrication will be accomplished in a conventional manner.

From the foregoing description those skilled in the art will appreciate that all of the objects of the present invention are realized. An improved molding machine has been shown and described for providing an increase in the number of building blocks molded in a given period of time. The rotational motion of a mold provided for in the present invention saves both time and the expense of improperly molded building blocks.

The molding machine operates to mold the LOEFFELSTEIN brand WATERLOFFEL brand pre-cast concrete module as well as any block that must be molded upside down due to block design, for example, any block with a solid or semi solid base. The molding machine of the present invention provides a pre-cast concrete bock or module configuration to any number of shapes, dimension tolerances, unit density or weight, and concrete strengths utilizing the rotating mold and translating receiving assembly.

The molding machine of the present invention incorporates the features of an otherwise conventional molding machine with its collecting hopper and feed box combination, pallet receiver, release conveyor, and appropriate mold.

The molding machine further integrates the conventional items required for the operation of the conventional molding machine and not illustrated in the drawings, including the following; a cement storage system; sand and aggregate bins; concrete mixer; conveyors for cement, sand, aggregate and mixed concrete, including conveyor to a feed box; air compressor system; electrical service; mold release agent and associated spray unit; curing room conveyors; overhead crane, if required; drying lids, plywood for clamping mold, pallets and necessary pallet handling equipment.

The molding machine incorporates desired molding block handling features and allows the mold to receive the proper degree of conventional pneumatic compaction pressure and vibration.

While specific embodiments have been shown and described, many variations are possible. The particular shape of the mold and molded item may vary while one feature of the invention is to provide for machine molding of blocks that are molded upside down due to their shape, configuration, or design. The molding machine materials and sizes may vary to suit the particular size of the machine. The number of molds per cycle may vary within reason with the size of the molds and the machine.

Various blocks may be made with the molding machine of the present invention including a mold that must be turned over in order to strip the molded block from the mold. A block that has a base or solid portion, e.g., splash block, is molded upside down and could be manufactured with the present invention with the appropriate mold attached or bolted to the mold support frame.

A motor and a rotary actuator have been suggested to rotate the mold by a manually operated system. Other rotary arrangements and computerized controlled systems may be applied to the present invention and all are within the scope of the claims.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. A molding machine for molding building blocks, comprising:

means for molding a building block;

supporting means for the molding means, the supporting means providing for rotational movement of the building block molding means from a mold material receiving position to a mold material stripping position after the building block is molded;

means for receiving and vertically moving a molded building block between a receiving position proximate the molding means and a transferring position;

means for transversely transferring the molded building block at the transferring position from the receiving means and means for conveying the molded building block, including a conveyor means placed in a fixed location and spaced from the receiving means for conveying the molded building block from a molding station to a curing station, the conveying means location being fixed proximate the transferring position and being integrally and continuously operable with the molding machine.

2. A molding machine as set forth in claim 1 wherein the supporting means provides for rotational movement of the molding means by a plurality of opposing shafts mounted in bearing means for rotational support of the opposing shafts.

3. A molding machine as set forth in claim 1 wherein the supporting means rotational movement is provided by a driven shaft operatively connected to the molding means supporting means.

4. A molding machine as set forth in claim 3 wherein the driven shaft motive power is provided by an electric motor.

5. A molding machine as set forth in claim 1 wherein the molded building block receiving mean sis a vertically reciprocating conveyor means for receiving the molded building block and subsequently transferring the molded building block to a fixed conveyor, the fixed conveyor conveying the molded building block from a molding station to a curing station.

6. A molding machine as set forth in claim 1 wherein the means for moving the molded building block receiving means includes means for providing generally vertical movement of the building block receiving means from a molded building block receiving position to a molded building block conveying position.

7. A molding machine for molding building blocks, comprising:

means for molding a building block;

supporting means for the molding means providing for rotational movement of the building block molding means, the supporting means providing for rotational movement of the molding means by a plurality of opposing shafts mounted in bearing means for rotational support of the opposing shafts;

a driven shaft operatively connected to the molding means supporting means providing supporting means rotational movement;

means for receiving and vertically moving a molded building block between a receiving position proximate the molding means and a transferring position;

means for transversely transferring the molded building block at the transferring position from the receiving means; and means for conveying the molded building block, including a conveying means placed in a fixed location and spaced from the receiving means for conveying the molded building block from a molding station to a curing station, the conveying means location being fixed proximate the transferring position and being integrally and continuously operable with the molding machine.

8. A molding machine as set forth in claim 7 wherein the driven shaft motive power is provided by an electric motor.

9. A molding machine as set forth in claim 7 wherein the molded building block receiving means is a vertically reciprocating conveyor means which moves between a raised molded block receiving position and a lowered molded building block transferring position for transferring the molded building block from the lowered position to a curing position for curing the molded building block.

10. A molding machine as set forth in claim 7 wherein the means for moving the molded building block receiving means includes means for providing generally vertical movement of the building block receiving means from a molded building block receiving position to a molded building block conveying position.

11. A mold machine as set forth in claim 10 wherein vertical movement is provided by a cylinder with a driven and reciprocating shaft arrangement.

12. A molding machine as set forth in claim 11 wherein the cylinder is operated by compressed air.

13. A molding machine as set forth in claim 7 wherein the means for transferring the molded building block from the molded building block receiving means is a pulling means, the pulling means reciprocating between an extended and a retracted position, whereby reciprocation of the pulling means engages a molded building block and transfers the molded building block from the molded building block receiving means to the conveying means for conveying the molded building block to a curing location.

14. A molding machine for molding building blocks, comprising:

means for molding a building block;

supporting means for the molding means providing for rotational movement of the building block molding means, the supporting means providing for rotational movement of the molding means by a plurality of opposing shafts mounted in bearing means for rotational support of the opposing shafts;

a driven shaft operatively connected to the molding means supporting means providing supporting means rotational movement;

means for receiving a molded building block, the molded building block receiving means including a generally vertical conveyor means for receiving the molded building block;

means for moving the molded building block vertical conveyor means between an upper receiving position proximate the molding means and moving the receiving means into a relatively lower conveying position, the means for moving the molded building block receiving means including means for providing generally vertical movement of the building block receiving means from the upper molded building block receiving position to the relatively lower molded building block conveying position; and means for transversely transferring the molded building block from the receiving means to a generally fixed horizontal conveying means.

15. A molding machine as set forth in claim 14 wherein the driven shaft motive power is provided by an electric motor.

16. A mold machine as set forth in claim 14 wherein vertical movement is provided by a cylinder with driven and reciprocating shaft arrangement.

17. A molding machine a set forth in claim 16 wherein the cylinder is operated by compressed air.

18. A molding machine as set forth in claim 14 wherein the means for transferring the molded building block from the relatively lower molded building block receiving means is a pulling means, the pulling means reciprocating between an extended and a retracted position, whereby reciprocation of the pulling means engages the molded building block and transfers the molded building block from the molded building block vertical conveyor means to the generally horizontal conveying means for conveying the molded building block to a curing station.

19. A molding machine as set forth in claim 14 wherein the driven shaft motive power is provided by an electric motor, chain driven and clutch assembly.

20. A molding machine as set forth in claim 14 wherein the driven shaft motor power is pneumatic.

* * * * *